US007096620B2

(12) United States Patent
Zeh

(10) Patent No.: US 7,096,620 B2
(45) Date of Patent: Aug. 29, 2006

(54) DEVICE FOR MOUNTING A TELESCOPIC SIGHT ON A WEAPON

(75) Inventor: Meinrad Zeh, Weitnau (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 11/169,000

(22) Filed: Jun. 28, 2005

(65) Prior Publication Data

US 2006/0010758 A1 Jan. 19, 2006

Related U.S. Application Data

(63) Continuation of application No. PCT/EP03/14884, filed on Dec. 24, 2003.

(30) Foreign Application Priority Data

Jan. 27, 2003 (DE) ..... 103 03 002

(51) Int. Cl.
*F41G 1/38* (2006.01)

(52) U.S. Cl. ..... 42/124

(58) Field of Classification Search ..... 42/124–128
See application file for complete search history.

(56) References Cited

U.S. PATENT DOCUMENTS 4,205,473 A * 6/1980 Wilson ..... 42/127
5,144,752 A 9/1992 Boeke et al.

FOREIGN PATENT DOCUMENTS

| | | | |
|---|---|---|---|
| DE | 21 37 659 | A | 2/1973 |
| DE | 22 40 844 | A | 2/1974 |
| DE | 298 06 544 | U1 | 11/1998 |
| GB | 735 414 | A | 8/1955 |
| GB | 9406408.3 | U1 | 9/1994 |

* cited by examiner

*Primary Examiner*—Stephen M. Johnson
*Assistant Examiner*—Gabriel J. Klein
(74) *Attorney, Agent, or Firm*—Martin Fleit; Paul D. Bianco; Fleit Kain Gibbons Gutman Bongini & Bianco P.L.

(57) ABSTRACT

The invention relates to a device for mounting a telescopic sight onto a weapon. The device is equipped with two mounting feet, which are positioned at a distance from one another and provided with mounting elements for engaging in corresponding receiving openings on the weapon. The aim of the invention is to enable the sight to be positioned accurately without the need for a complex adjustment and fitting process. To achieve this, the mounting elements are configured by clamping bolts, which comprise laterally protruding lugs, are contained in the corresponding mounting feet and can be rotated through a release and locking position. The lugs can be inserted into recesses between inward-facing projecting shoulders of the receiving openings in the release position of the clamping bolts and engage with the underside of the projecting shoulders in the locked position of the bolts.

12 Claims, 4 Drawing Sheets

DEVICE FOR MOUNTING A TELESCOPIC SIGHT ON A WEAPON

CROSS-REFERENCE TO RELATED APPLICATION

This application is a continuation of International Application No. PCT/EP2003/014884 filed Dec. 24, 2003, the contents of which are incorporated herein by reference.

FIELD OF THE INVENTION

The invention pertains to a device for mounting a telescopic sight on a weapon.

BACKGROUND OF THE INVENTION

A mounting device of this type is known from U.S. Pat. No. 4,205,473. In one embodiment disclosed in this publication, a clamping bolt with a downwardly projecting interlocking extension is respectively arranged in two mounting feet that are spaced apart from one another, so that it can be turned between a release position and a locking position. The interlocking extension is realized in the form of a truncated cone with a lateral flattening that is designed for engaging into a slot in a holding plate mounted on the weapon in the release position of the clamping bolt. When the clamping bolt is turned, the interlocking extension engages underneath the holding plate similarly to a quarter-turn fastener. The clamping bolts are rotatably guided in corresponding bores of the mounting feet with the aid of upwardly projecting pins and held in said bores by means of screws.

SUMMARY OF THE INVENTION

The invention is based on the objective of developing a device for mounting a telescopic sight on a weapon that can be easily operated and also allows a precise and secure arrangement of the telescopic sight on the weapon without the need for complicated adjusting and fitting processes.

This objective is realized with a device as set forth in the claims. Practical embodiments and advantageous additional developments of the invention are also recited in the claims.

In the mounting device according to the invention, the clamping bolts that project downward from the mounting feet are prestressed upward by means of a plate spring or another spring element. When the clamping bolts are turned into their locking position, they are pulled downward against the force of the spring such that the interlocking extensions on the clamping bolts engage into the receiving openings on the underside of the shoulders under a certain tension. The resulting generated tensile stress can be easily adjusted by appropriate selection of the spring or by utilizing a corresponding plate spring assembly. The spring element also represents a simple option for compensating for axial tolerances. The underside of the respective mounting feet is additionally provided with a guide pin that is designed for being precisely inserted into a cylindrical guide section of the receiving opening. This makes it possible to achieve an accurate, repeatable positioning and precisely positioned mounting of the telescopic sight on the weapon.

In one practical embodiment, the mounting feet have a lower plane contact surface for being supported on an upper plane contact surface of the receiving openings provided on the weapon. Due to these measures, an accurate, repeatable lateral, longitudinal and vertical positioning and therefore a precisely positioned mounting of the telescopic sight on the weapon is effected.

The two clamping bolts are simply turned by means of one respective laterally protruding lever that simultaneously serves for axially securing the clamping bolts within the mounting feet. However, the levers may also be turned by means of other actuating elements, e.g., a handwheel or the like.

BRIEF DESCRIPTION OF THE DRAWINGS

Other peculiarities and advantages of the invention are discussed below with reference to a preferred embodiment that is illustrated in the drawings. It shows.

DETAILED DESCRIPTION OF THE INVENTION

Figure 1:
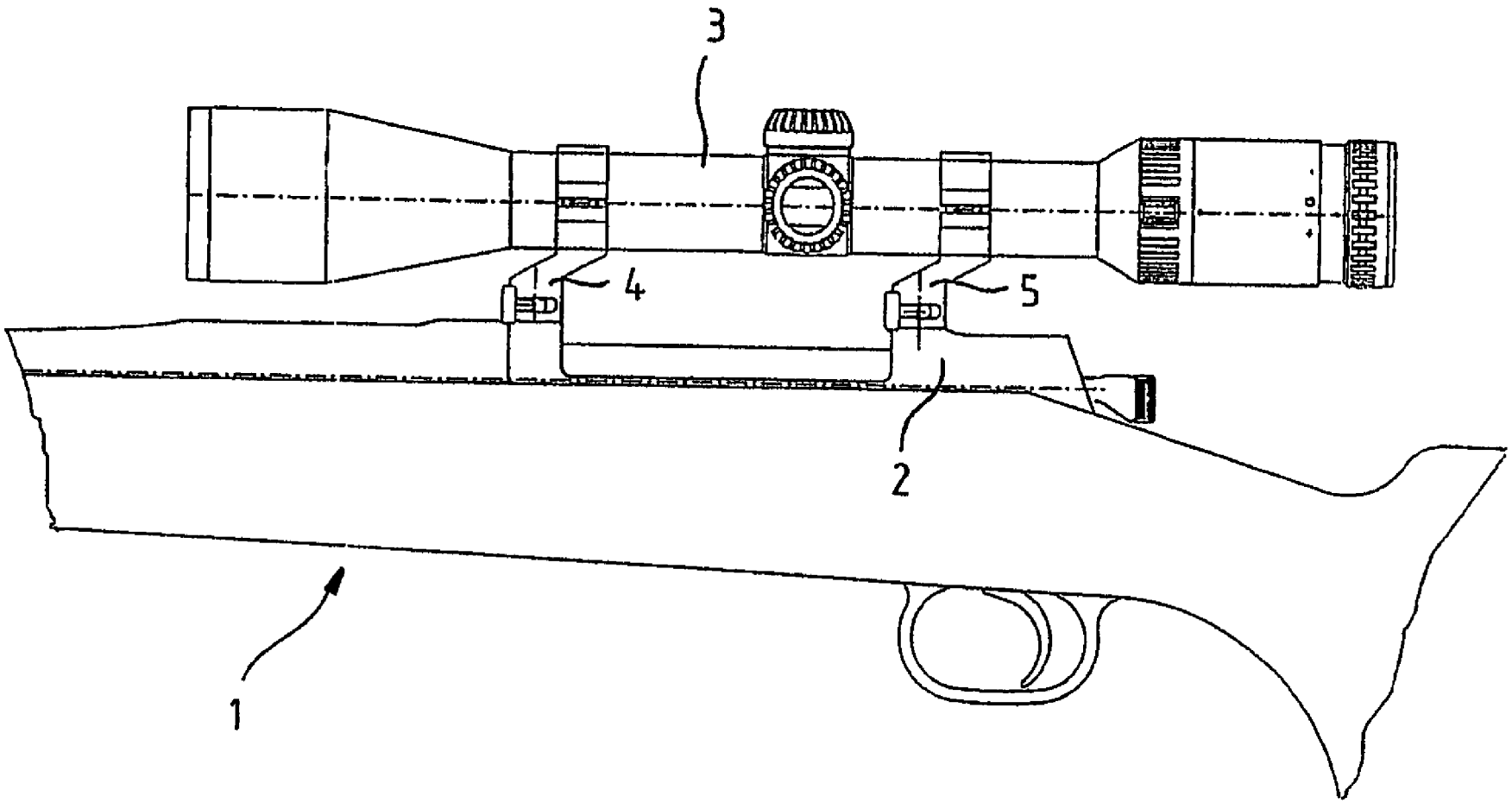
FIG. 1, a schematic side view of part of a repeating rifle with a telescopic sight and a device for mounting the telescopic sight.

FIG. 1 shows part of a repeating rifle 1 with a chamber housing 2, a telescopic sight 3 and a device for mounting the telescopic sight 3 that is described in greater detail below. The mounting device contains two mounting feet 4 and 5 that are spaced apart from one another and realized integrally with the lower segment of a generally known two-part mounting ring in the embodiment according to FIG. 1.

Figure 2:
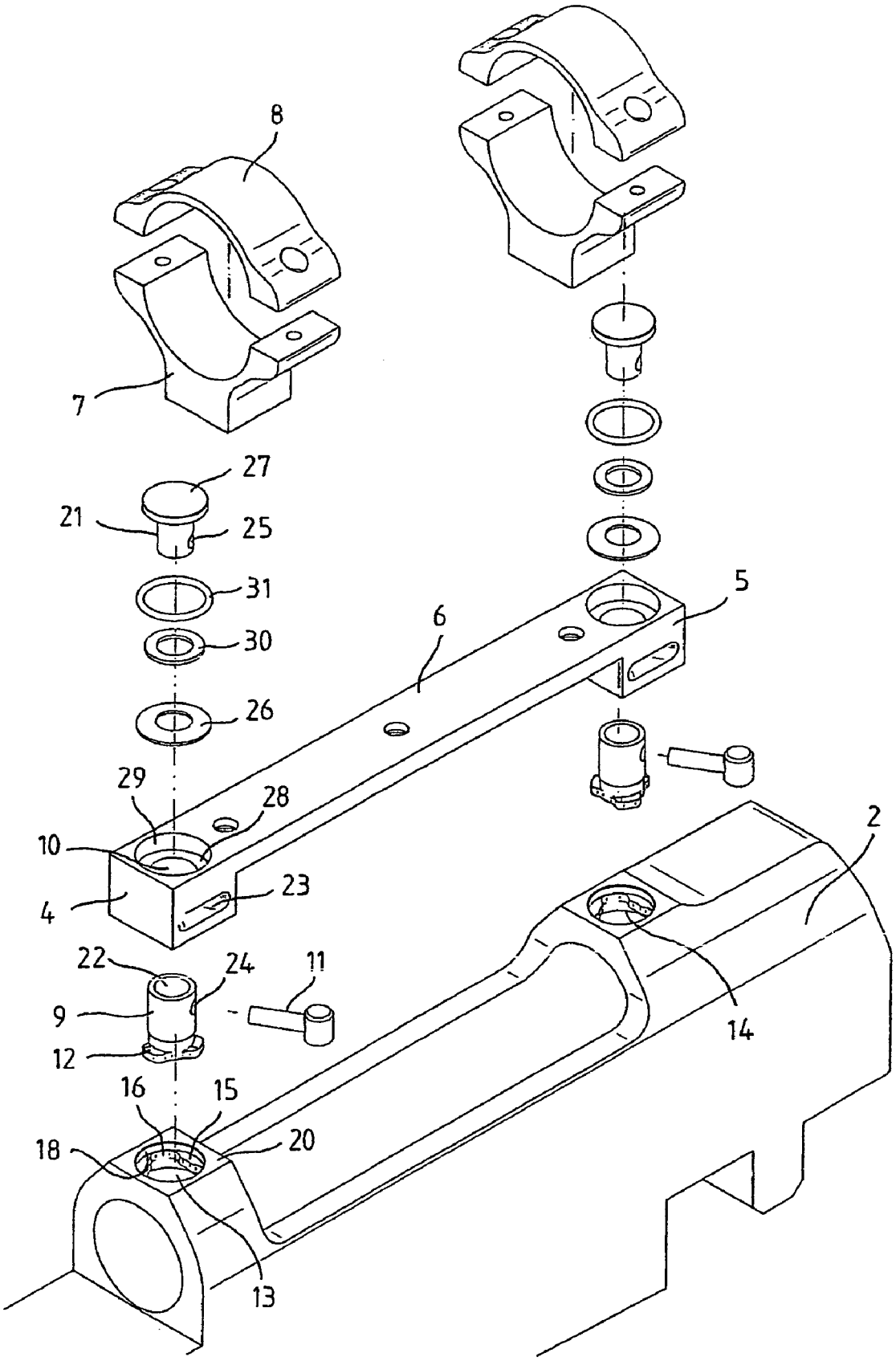
FIG. 2, an exploded view of another device for mounting a telescopic sight.

FIG. 2 shows another embodiment of a mounting device, in which the two mounting feet 4 and 5 are situated on the front end and the rear end of a common mounting bridge 6. Two mounting rings that respectively comprise a lower ring segment 7 and an upper ring segment 8 to be screwed together can be fixed on the mounting bridge 6 in order to removably mount the telescopic sight 3. Although the mounting feet 4 and 5 shown in the figures are realized integrally with the mounting bridge 6, they may also consist of separate components that can be fixed on a mounting bridge or mounted on separate mounting rings or other suitable holding arrangements for telescopic sights.

The two mounting feet 4 and 5 respectively contain a downwardly protruding clamping bolt 9 that is prestressed upward and arranged within a continuous bore 10 in an axially movable fashion, namely such that it can be turned between a release position and a locking position by means of a lateral lever 11. On their lower ends, both clamping bolts 9 are respectively provided with three laterally projecting interlocking extensions 12 that are equidistantly spaced apart from one another in the circumferential direction of the clamping bolt and designed for engaging into corresponding receiving openings 13 and 14 on the upper side of the chamber housing 2. Three inwardly projecting shoulders 15 with recesses 16 arranged therebetween are situated on the inner side of the receiving openings 13 and 14. The shoulders 15 and the recesses 16 of the receiving openings 13 and 14 are realized in such a way that the interlocking extensions 12 of the clamping bolts 9 can be inserted into the recesses 16 in the release position of the clamping bolts and engage underneath the shoulders 15 in the locking position [of the clamping bolts] 9 such that they simultaneously contact the underside of the shoulders. Since both mounting feet 4 and 5 with the clamping bolts 9 arranged therein have the same design, only the front mounting foot 4 is described in greater detail below. This description applies analogously to the rear mounting foot 5.

Figure 3:
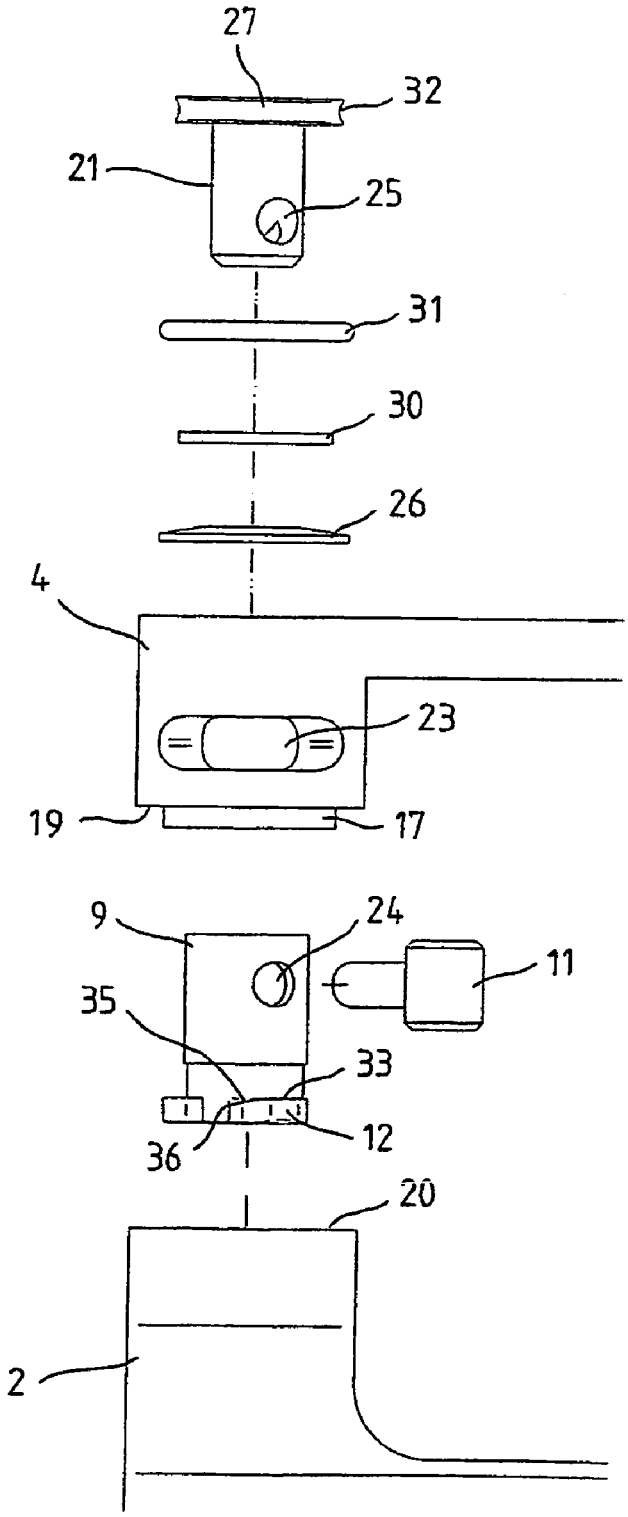
FIG. 3, an enlarged exploded view of the front mounting foot of the device according to FIG. 2.
Figure 4:
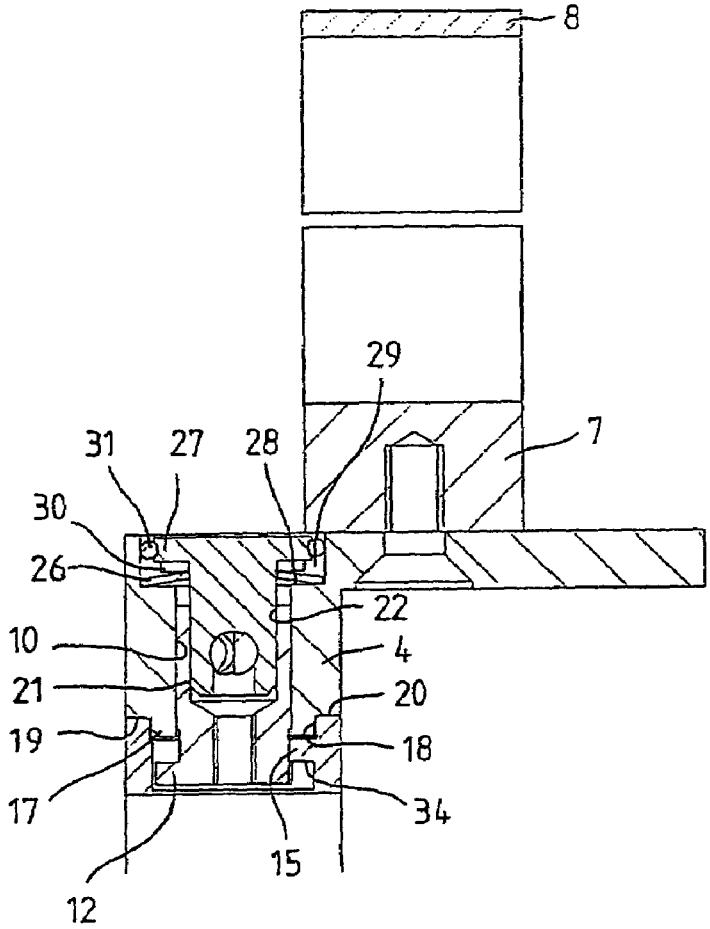
FIG. 4, an enlarged sectional representation of the front mounting foot according to FIG. 2, and FIG. 5, a section of a rifle barrel with receiving openings for mounting the telescopic sight.

According to FIGS. 3 and 4, in particular, the underside of the front mounting foot 4 contains a guide pin 17 that serves for being inserted into the upper cylindrical guide section 18 of the receiving opening 13 shown in FIGS. 2 and 4 in a precisely fitted fashion. A lower contact surface 19 is provided on the underside of the mounting foot 4 around the guide pin 17, wherein said contact surface is designed for being supported on an upper contact surface 20 of the chamber housing 2. The two contact surfaces 19 and 20 as well as the guide pin 17 that engages into the upper guide section 18 of the receiving opening 13 in a precisely fitted fashion make it possible to achieve an accurately repeatable lateral, longitudinal and vertical positioning of the mounting foot 4 and therefore a precisely positioned mounting of the telescopic sight on the weapon, namely even if the sight is repeatedly removed.

The clamping bolt 9 that protrudes downward from the mounting foot 4 is removably held in the through-bore 10 of the mounting foot 4 by means of a pin 21. For this purpose, the pin 21 engages into a corresponding opening 22 on the upper side of the clamping bolt 9 with its lower part. The separable connection between the pin 21 and the clamping bolt 9 is realized with the aid of the lever 11 that is inserted into a lateral bore 25 of the pin 21 through a lateral transverse slot 23 in the mounting foot 4 and a transverse bore 24 of the clamping bolt 9. The lever is secured from falling out with a not-shown safety screw or the like. The width of the transverse slot 23 is chosen such that the lever 11 comes in contact with the rear end of the transverse slot 23 in the release position of the clamping bolt 9 and with its front end in the locking position of the clamping bolt. The transverse slot 23 also has a greater height than the part of the lever 11 being displaced therein such that the clamping bolt 9 is axially movable within a range that is defined by the height of the transverse slot 23. The mounting bolt 9 is prestressed upward by means of a plate spring 26 that is braced between a widened head 27 of the pin 21 and an inner contact surface 28 of a countersinking 29 of the through-bore 10 on the upper side of the mounting foot 4. A washer 30 is arranged between the plate spring 26 and the head 27 of the pin 21. The force of the plate spring 26 in the locking position of the clamping bolt 9 can be adjusted by choosing the thickness of the washer 30 accordingly. The head 27 of the pin 21 is sealed within the countersinking 29 by means of a ring seal 31 that lies in a semicircular groove 32 on the outer side of the head 27 as shown in FIG. 3.

According to FIG. 3, the outwardly projecting interlocking extensions 12 of the clamping bolt 9 have a plane upper clamping surface 33 that comes in contact with a plane lower surface 34 of the shoulders 15 on the receiving opening 13 as shown in FIG. 4 when the clamping bolt 9 is turned into the locking position. On their front side referred to the rotating direction into the locking position, the interlocking extensions 12 are provided with a beveled surface, the front edge 36 of which lies slightly underneath the lower surface 34 of the shoulders 15 in the upwardly prestressed release position of the clamping bolt 9.

In order to install the clamping bolt 9 into the respective mounting foot 4 or 5, the clamping bolt 9 is initially inserted into the through-bore 10 from the bottom. The plate spring 26 and the washer 30 are then attached from the top. Subsequently, the pin 21 and the ring seal 31 are inserted into the upper opening 22 of the clamping bolt 9 in such a way that the lateral bore 25 of the pin is aligned with the transverse bore 24 of the clamping bolt 9. The lever 11 can then be inserted into the bore 25 through the lateral transverse slot 23 and the transverse bore 24 and secured from falling out by means of a not-shown safety pin or the like. This means that the individual parts arranged within the mounting foot can be easily installed and removed in case they need to be replaced. The lever 11 fulfills two function, namely that of an actuating element for turning the clamping bolt 9, as well as that of a connecting element for holding together the individual components and for axially securing the clamping bolt within the mounting foot.

When the telescopic sight 3 must be mounted on the repeating rifle 1, the two mounting feet 4 and 5 are simply placed on the respective receiving openings 13 and 14 while the clamping bolts 9 are in the release position, wherein the lateral interlocking extensions 12 on the clamping bolts 9 engage into the recesses 16 between the shoulders 15 on the receiving openings 13 and 14. The two clamping bolts 9 are subsequently turned with the aid of the levers 11 such that both clamping bolts 9 are pulled downward against the force of the plate spring 26 by the beveled surfaces 34, namely until their plane upper clamping surfaces 33 adjoin the lower surfaces 34 of the shoulders 15 under a certain prestress in the locking position. The mounting bridge 6 with the telescopic sight 3 fixed thereon can be securely held on the chamber housing 2 in this fashion. In order to remove the telescopic sight, it is merely required to displace the two levers 11 into their rear release position such that the mounting bridge 6 with the telescopic sight 3 fixed thereon can be easily removed.

Figure 5:
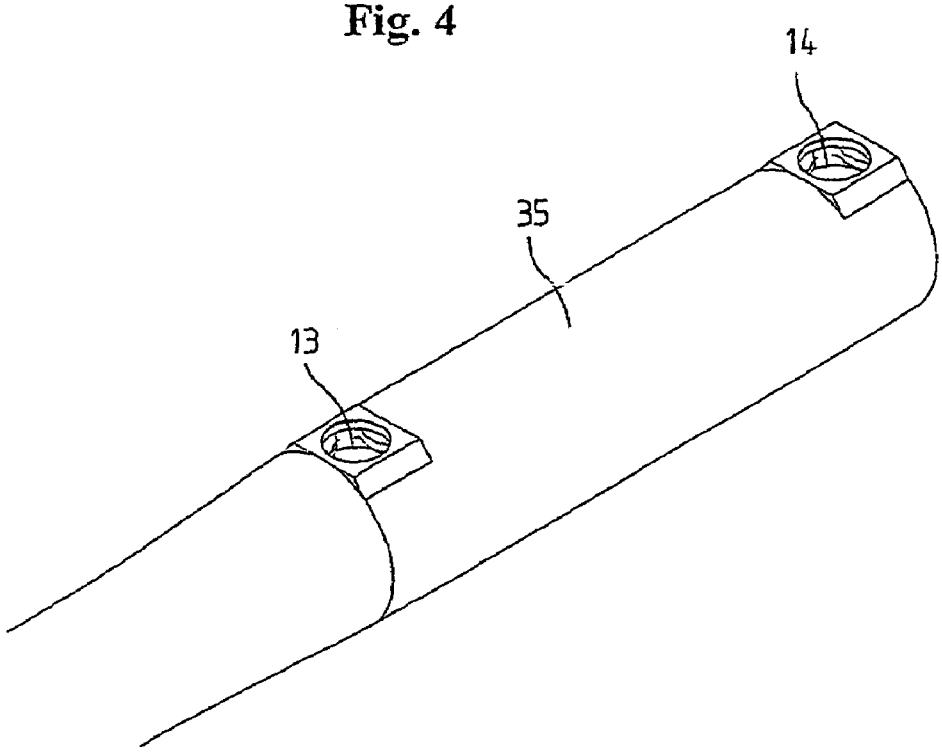

The above-described mounting device is not only suitable for being mounted on chamber housings of repeating rifles. It may also be used accordingly for mounting a telescopic sight on a barrel section 35 that is provided with corresponding receiving openings 13 and 14 as shown in FIG. 5.

The invention claimed is:

1. A device for mounting a telescopic sight on a weapon, comprising two mounting feet that are spaced apart from one another and in which clamping bolts provided with laterally projecting interlocking extensions are arranged such that the clamping bolts can be turned between a release position and a locking position, wherein the interlocking extensions can be inserted into recesses between inwardly projecting shoulders of receiving openings of the weapon when the clamping bolts are in their release position, and wherein said interlocking extensions engage underneath the shoulders in the locking position of the clamping bolt, wherein the clamping bolts project downward from the mounting feet and are prestressed upwardly by a spring element, and the underside of the respective mounting feet contains a guide pin that is designed to be inserted into a cylindrical guide section of the receiving openings in precisely fitted fashion.

2. The device according to claim 1, wherein the mounting feet have a lower contact surface for being supported on an upper contact surface on the receiving openings of the weapon.

3. The device according to claim 1, wherein each clamping bolt can be turned by means of a laterally protruding lever.

4. The device according to claim 3, wherein the levers are inserted into a lateral bore of a pin that is inserted into the clamping bolt through a transverse bore of the clamping bolt.

5. The device according to claim 4, wherein the spring elements consist of at least one respective plate spring that is braced between a head of the pin and an inner contact surface of a countersinking on the upper side of the mounting feet.

6. The device according to claim 4, wherein the pins are sealed relative to the respective mounting feet by means of ring seals.

7. The device according to claim 3, wherein the levers are connected to the clamping bolts and project outwardly through lateral transverse slots in the mounting feet.

8. The device according to claim 1, wherein the interlocking extensions have a beveled barrel approach part on their front end and an upper clamping surface that is designed for contacting a lower surface of the shoulders.

9. The device according to claim 1, wherein the two mounting feet are arranged separately of one another on one respective mounting ring or another suitable holding arrangement for a telescopic sight.

10. The device according to claim 1, wherein both mounting feet are arranged on a common mounting bridge.

11. The device according to claim 1, wherein the receiving openings are arranged on the chamber housing of a repeating rifle.

12. The device according to claim 1, wherein the receiving openings are arranged on a barrel section of the weapon.

* * * * *